US006811097B2

(12) United States Patent
Dantes et al.

(10) Patent No.: US 6,811,097 B2
(45) Date of Patent: Nov. 2, 2004

(54) FUEL INJECTION VALVE

(75) Inventors: Guenter Dantes, Eberdingen (DE); Detlef Nowak, Untergruppenbach (DE); Matthias Waldau, Pforzheim (DE)

(73) Assignee: Robert Bosch GmbH, Stuttgart (DE)

( * ) Notice: Subject to any disclaimer, the term of this patent is extended or adjusted under 35 U.S.C. 154(b) by 65 days.

(21) Appl. No.: 10/130,575

(22) PCT Filed: Aug. 25, 2001

(86) PCT No.: PCT/DE01/03259

§ 371 (c)(1),
(2), (4) Date: Nov. 21, 2002

(87) PCT Pub. No.: WO02/25100

PCT Pub. Date: Mar. 28, 2002

(65) Prior Publication Data

US 2003/0173424 A1 Sep. 18, 2003

(30) Foreign Application Priority Data

Sep. 19, 2002 (DE) ..... 100 46 306

(51) Int. Cl.[7] ..... B05B 1/34

(52) U.S. Cl. ..... 239/497; 239/466; 239/494; 239/553.12; 239/585.1

(58) Field of Search ..... 239/553.3, 533.12, 239/585.1, 585.5, 900, 463, 466, 487, 491, 494, 497, 500, 501

(56) References Cited

U.S. PATENT DOCUMENTS

| | | | | |
|---|---|---|---|---|
| 4,923,169 | A | 5/1990 | Bata et al. | |
| 5,285,970 | A | 2/1994 | Maier et al. | |
| 5,996,912 | A | 12/1999 | Shen et al. | |
| 6,168,098 | B1 * | 1/2001 | Brinn, Jr. | 239/585.4 |
| 6,669,116 | B2 * | 12/2003 | Iwase | 239/533.12 |

FOREIGN PATENT DOCUMENTS

| | | |
|---|---|---|
| DE | 197 36 682 | 2/1999 |
| DE | 198 15 789 | 10/1999 |
| DE | 198 15 800 | 10/1999 |

* cited by examiner

*Primary Examiner*—Christopher Kim
(74) *Attorney, Agent, or Firm*—Kenyon & Kenyon

(57) ABSTRACT

A fuel injector, for example, for direct injection of fuel into a combustion chamber of an internal combustion engine, having a valve-closure member, which forms a sealing seat together with a valve-seat surface constructed on a valve-seat member, and having a swirl disk with fuel passages, the swirl disk being constructed from a plurality of swirl elements, each of the swirl elements having the same number of fuel passages. The swirl elements are offset with respect to one another, so that the fuel passages at least partially overlap.

8 Claims, 3 Drawing Sheets

FUEL INJECTION VALVE

FIELD OF THE INVENTION

The present invention relates to a fuel injector.

BACKGROUND INFORMATION

A fuel injector is referred to in German Patent Application No. 197 36 682, in which a guide and seating area, which are formed from three disk-shaped elements, are provided on the downstream end of the valve. A swirl element is imbedded between a guide element and a valve seat element. The guide element guides an axially movable valve needle projecting through the guide element, and a valve closing section of the valve needle cooperates with a valve-seat surface of the valve seat element. The swirl element has an inner opening area containing a plurality of swirl channels, which are not connected to the outer periphery of the swirl element. The entire opening area extends completely over the axial depth of the swirl element.

In addition, a fuel injector is referred to in German Patent Application No. 198 15 789, in which the fuel injector has a swirl disk located downstream from a valve seat, the swirl disk including at least one metallic material and having at least two swirl channels opening into a swirl chamber. All the layers of the swirl disk are adhesively deposited by electrodeposition (multilayer metallization), one on top of the other. The swirl disk is installed in the valve, so that its surface normal extends diagonally to the longitudinal axis of the valve at an angle deviating from 0° is obtained by aligning the swirl disk so that a jet angle $\gamma$, with respect to the longitudinal axis of the valve.

It is believed that a disadvantage of the fuel injectors described above is the high cost associated with complicated manufacturing requirements. Modifying the fuel injector for a desired use may require the use of complicated manufacturing procedures. For example, jet angles $\alpha$ and $\gamma$ may not be achieved using common swirl generation methods.

SUMMARY

It is believed that an exemplary fuel injector according to the present invention has the advantage in that a swirl disk, having individual swirl elements, is easily manufacturable and may be used in standard fuel injectors. The number of swirl elements, as well as the number of overlapping fuel passages forming fuel channels, which impart swirl on the fuel, may be varied as desired and may be easily adapted according to the demands on the fuel injector.

It is also believed to be advantageous in that the swirl disk may be situated either on the inflow side or on the outflow side of the sealing seat, depending on the construction of the fuel injector.

In addition, it is believed that an inclination of the longitudinal axis of the valve-seat member with respect to the longitudinal axis of the fuel injector is advantageous for use in inclined injection.

It is also believed to be advantageous to construct a swirl chamber on the outflow side of the swirl disk, the swirl chamber being suitably dimensioned, so that a homogeneous swirl flow may be formed.

It is also believed to be advantageous to arrange the swirl disk in a plug-in unit, which is insertable into the valve-seat member, since the plug-in unit, as well as a cavity accommodating the plug-in unit, may be easily manufacturable.

DETAILED DESCRIPTION

Figure 1:
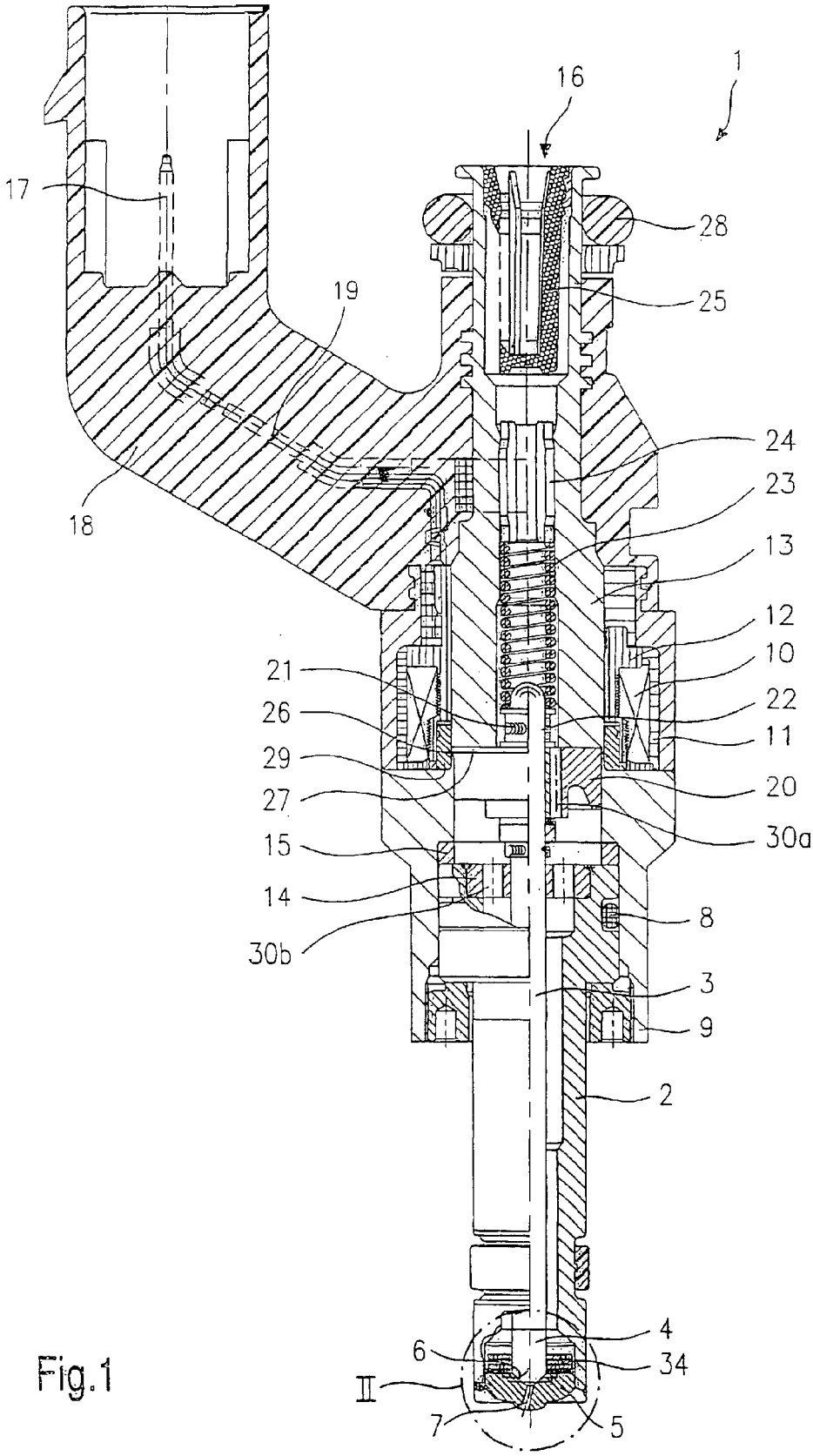
FIG. 1 is a partial sectional view through a first exemplary fuel injector according to the present invention.

Fuel injector 1 may be a fuel injector 1 for a fuel injection system of an internal combustion engine having compression of an fuel/air mixture with spark ignition. Fuel injector 1 may be suitable, for example, for direct injection of fuel into a combustion chamber (not shown) of an internal combustion engine.

Fuel injector 1 has a nozzle body 2, in which a valve needle 3 is situated. Valve needle 3 is mechanically linked to a valve-closure member 4, which cooperates with a valve-seat surface 6 situated on a valve-seat member 5 to form a sealing seat. Valve-seat member 5 is insertable into a cavity 50 of nozzle body 2. In the exemplary embodiment illustrated in FIG. 1, fuel injector 1 is an inwardly opening fuel injector 1 having a spray-discharge orifice 7. Gasket 8 seals nozzle body 2 with respect to a stationary pole 9 of a solenoid 10. Solenoid 10 is encapsulated in a coil casing 11 and is wound onto a field frame 12, which contacts an internal pole 13 of solenoid 10. Gap 26 separates internal pole 13 from stationary pole 9, which are supported on a connecting component 29. An electric plug-in contact 17 energizes solenoid 10 by an electric current supplied over a line 19. Plastic sheathing 18, which extrudes onto internal pole 13, encloses plug-in contact 17.

Valve needle 3 is guided in a valve needle guide 14, which may be designed, for example, as a disk. A matching adjusting disk 15 adjusts the lift. An armature 20 is situated on the other side of adjusting disk 15. The armature is in friction-locked connection to valve needle 3 via a first flange 21, the valve needle being connected to first flange 21 by a weld 22. A restoring spring 23 is supported on first flange 21 and is under prestress by a sleeve 24.

A second flange 31, which is connected to valve needle 3 by a weld 33, is used as a lower armature stop. An elastic intermediate ring 32, which rests on second flange 31, prevents rebounding when fuel injector 1 is closed.

Fuel channels 30*a* and 30*b* extend in valve needle guide 14 and in armature 20 and conduct the fuel to spray-discharge orifice 7, the fuel being supplied through a central fuel feed 16 and filtered through a filter element 25. Gasket 28 seals fuel injector 1 with respect to a fuel line (not shown).

A swirl disk 34 is arranged on the inflow side of valve-seat member 5, the swirl disk 34 being formed from four swirl elements 36*a* through 36*d*. Swirl elements 36 are welded to one another and to valve-seat member 5. Valve needle 3 extends through swirl disk 34 and is led through a cardanic valve needle guide 46 to avoid off-center displacement and tilting.

Swirl elements 36 of swirl disk 34 include fuel passages 35*a* through 35*d*, which overlap to form fuel channels 37 extending through swirl disk 34.

In the resting state of fuel injector 1, restoring spring 23 acts upon armature 20 against its direction of lift, so that valve-closure member 4 is held in sealing contact with valve-seat surface 6. When solenoid 10 is energized, a magnetic field is created, which moves armature 20 in the direction of lift against the spring force of restoring spring 23, the lift being predetermined by a working gap 27 located between internal pole 12 and armature 20 in the resting position. Armature 20 entrains flange 21 in the direction of lift, flange 21 being welded to valve needle 3. Valve-closure member 4, which is mechanically linked to valve needle 3, is lifted from valve-seat surface 6, and the fuel is led to spray-discharge orifice 7 via fuel channels 30*a*and 30*b* and via fuel channels 37 formed in swirl disk 34, where it is injected. The spray-discharge orifice may be inclined, for example, at an injection angle γ with respect to a longitudinal axis 45 of fuel injector 1.

When the coil current is turned off, armature 20 drops away from internal pole 13, due to the pressure of restoring spring 23, after the magnetic field has sufficiently decayed, so that flange 21, which is mechanically linked to valve needle 3, moves in the direction opposite the direction of lift. Valve needle 3 is thereby moved in the same direction, so that valve-closure member 4 is set down on valve-seat surface 6 and fuel injector 1 is closed.

Figure 2A:
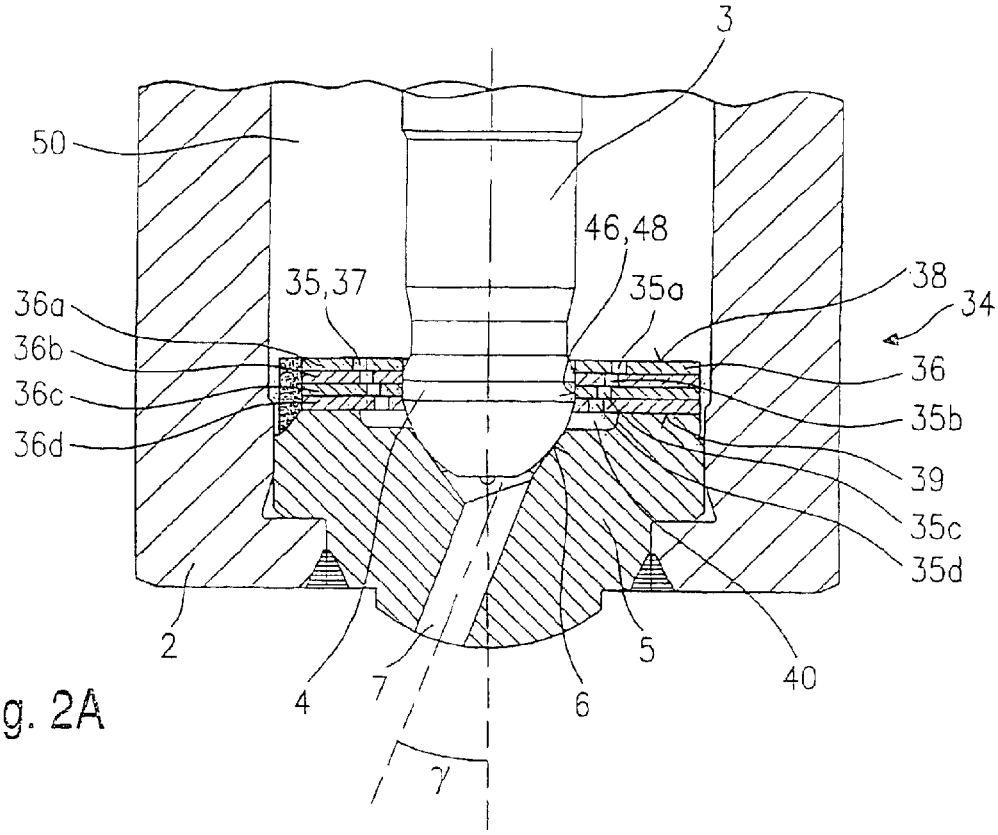
FIG. 2A is a partial sectional view of region II of the first exemplary fuel injector illustrated in FIG. 1.

FIG. 2A is an enlarged sectional view of the injection-side portion of the first exemplary fuel injector 1 according to the present invention illustrated in FIG. 1. The shown section is denoted by II in FIG. 1.

Swirl disk 34, which may be constructed from four swirl elements 36, is inserted into a central cavity 47 in fuel injector 1 and rests on valve-seat member 5. To protect against displacement or lifting when fuel injector 1 is actuated, the four swirl elements 36 may be welded or soldered to one another, as well as to valve-seat member 5. However, swirl elements 36 may also be formed in multiple layers by an electrodeposition process.

The four swirl elements 36 each have the same number of fuel passages 35. In the exemplary embodiment illustrated in FIG. 2A, four fuel passages 35*a* through 35*d* are illustrated. However, the number of fuel passages may be increased if desired, considering stability and flow maintenance criteria. Fuel passages 35 may be produced, for example, by erosion, punching, etching, drilling, or similar methods. To form a turbulence-producing fuel channel 37 extending from a side 38 on the inflow side of swirl disk 34 to a side 39 on the outflow side of swirl disk 34, fuel passages 35 are offset with respect to one another, so that they at least partially overlap. The displacements in individual swirl elements 36 are produced in the same direction. To produce turbulence, the fuel passages are offset axially, but may also have a radial offset component. Swirl disk 34 may be connected to nozzle body 2 or to valve-seat member 5 by soldering, welding, caulking, press-fitting, or similar methods.

Figure 2B:
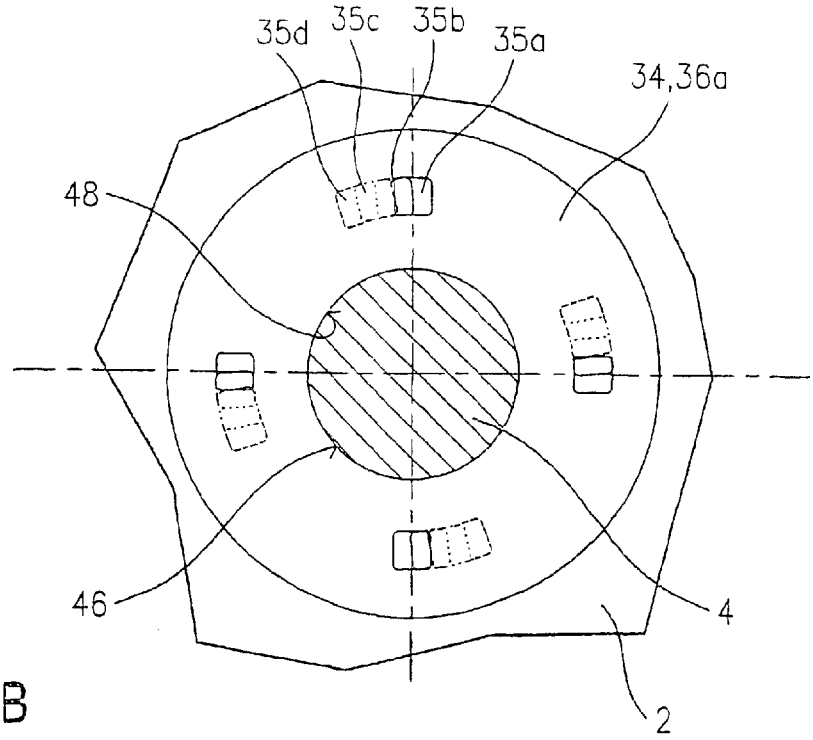
FIG. 2B is a top view of the swirl disk illustrated in FIG. 2A, in the direction of outflow.

The cross section of fuel passages 35 may be square shaped with rounded corners. As shown in FIG. 2B, however, the cross section may also resemble other shapes. For example, fuel passages 35 may have a round or oblong cross section. It is believed that rounded shapes are advantageous in that they optimize flow.

The sealing seat of fuel injector 1 may include valve-closure member 4 constructed on valve needle 3 and passing through swirl disk 34. In this manner, swirl disk 34 may form a valve needle guide in the region of the sealing seat. Valve-closure member 4 cooperates with valve-seat surface 6, which is constructed on valve-seat member 5. A swirl chamber 40 is thus formed on the inflow side of valve-seat surface 6, which is delimited by valve-seat member 5, valve-closure member 4 and swirl disk 34.

Fuel channels 37, formed by overlapping fuel passages 35, open into swirl chamber 40. The volume of swirl chamber 40 may be optimally dimensioned, so that a stable turbulent flow, which is homogeneous in the circumferential direction, may be formed with the dead volume kept as low as possible.

When fuel injector 1 is actuated, fuel flows through fuel channels 37 into swirl chamber 40 and, after the fuel lifts valve-closure member 4 from valve-seat surface 6, the fuel exits the swirl chamber via spray-discharge orifice 7. Turbulence is thus maintained, so that the fuel is injected in a spiral fashion into the combustion chamber (not shown) of an internal combustion engine.

FIG. 2B is a top view of swirl disk 34 of the first exemplary fuel injector 1 according to the present invention shown in FIG. 2A, in the direction of outflow.

FIG. 2B shows the inflow side of first swirl element 36*a*, the four fuel passages 35*a* of which are square with rounded corners and represented by a solid line. Fuel passages 35*b* of second swirl element 36*b* on the injection side are partially visible through fuel passages 35*a* of first swirl element 36*a*. In the visible areas, fuel passages 35*b* are represented by solid lines, and concealed areas are represented by dotted lines. Fuel passages 35*c*, formed in subsequent third swirl element 36*c*, are barely visible through fuel passages 35*a* of swirl element 36*a*, since fuel passages 35*a* through 35*c* overlap one another by approximately 50%. As a result, fuel passages 35*d* of fourth swirl element 36*d* are not visible through fuel passages 35*a* of first swirl element 36*a*.

Since swirl disk 34 is also used as a cardanic valve needle guide 46 for valve-closure member 4, swirl elements 36 form a ring having a central cavity 48, in which valve-closure member 4 is guided. Cardanic valve needle guide 46 compensates for guide errors in the inflow-side region of fuel injector 1 resulting from inaccuracies in manufacturing, since valve-closure member 4 is generally spherical in shape and thus has multiple degrees of freedom, in which to compensate for displacements. Valve needle 3 may be manufactured in two parts, for example, using a sphere for valve-closure member 4 and a shaft for valve needle 3. However, one-part constructions, such as in the present exemplary embodiment, may also be used when an appropriately designed valve-closure member 4 is provided.

Figure 3A:
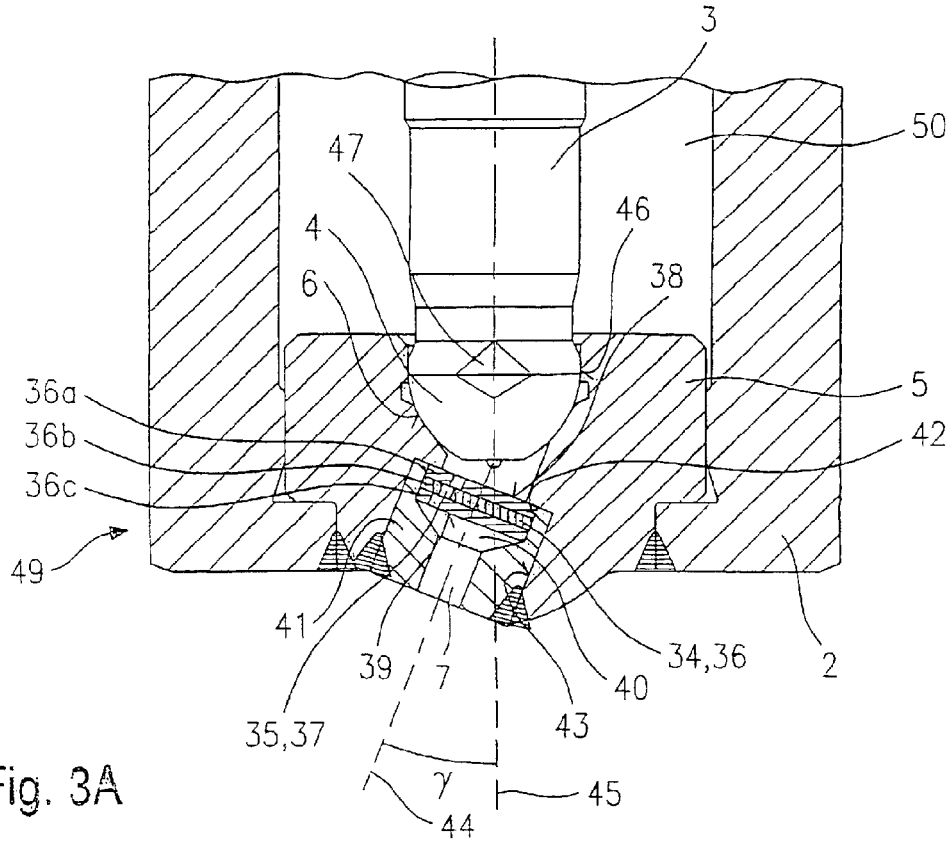
FIG. 3A is a partial sectional view of a region II of a second exemplary fuel injector according to the present invention.

FIG. 3A shows a second exemplary fuel injector 1 according to the present invention. Corresponding parts are provided with the same reference numbers.

In contrast to exemplary fuel injector 1 illustrated in FIG. 2A, the exemplary fuel injector 1 illustrated in FIG. 3A includes swirl disk 36 situated downstream from the sealing seat. In addition, fuel injector 1 is a diagonally injecting fuel injector 1, which enables better adjustment of an injection angle γ compared to an inclination of spray-discharge orifice 7. A longitudinal axis 44 of an injection unit 49 accommodating swirl disk 34 is thus inclined with respect to longitudinal axis 45 of fuel injector 1. However, longitudinal axis 44 of injection unit 49 may also coincide with longitudinal axis 45 of fuel injector 1, it being necessary to incline spray-discharge orifice 7 to achieve injection angle γ.

In the exemplary fuel injector 1 illustrated in FIG. 3A, valve-seat member 5 has a cardanic valve needle guide 46 to counteract tilting and off-center displacements of valve needle 3 using a spherical guide. For conducting fuel, valve-closure member 4 is provided with at least one ground face 47 in the region of cardanic valve needle guide 46.

On the outflow side of the sealing seat, valve-seat member 5 may have a cylindrical cavity 43, in which a plug-in unit 41 may be inserted. Plug-in unit 41 has a cylindrical shape. Swirl disk 34, which may have three swirl elements 36, is situated in a cavity 42 of plug-in unit 41. swirl chamber 40 is constructed downstream from swirl disk 34. Fuel channels 37, which are formed from overlapping fuel passages 35 of swirl elements 36, open into the swirl chamber 40, which merges into spray-discharge orifice 7.

In the exemplary fuel injector 1 illustrated in FIG. 3A, swirl disk 34 has three swirl elements 36*a* through 36*c*, each swirl element 36 having four fuel passages 35. By arranging swirl disk 34 on the outflow side of the sealing seat, it may not be necessary to weld swirl elements 36 to one another or to plug-in unit 41, since swirl elements 36 are acted upon by the fuel pressure in the downstream direction and therefore are not displaceable in the direction opposite the direction of flow. The modular design of fuel injector 1 may thus be further simplified. Nevertheless, it is believed to be advantageous to adhere or weld swirl elements 36 to one another, or to produce swirl disk 34 in one piece by electrodeposition, so that, after assembly, it may not be possible to change the position of fuel passages 35 with respect to one another, which displacement otherwise may limit the turbulence effect and the fuel flow rate.

When fuel injector 1 is actuated, the fuel flows around valve-closure member 4 via ground face 47, and turbulence is imparted on the fuel as it passes the sealing seat in swirl disk 34. The fuel thus moves in a spiral fashion through spray-discharge orifice 7 into the combustion chamber (not shown).

Figure 3B:
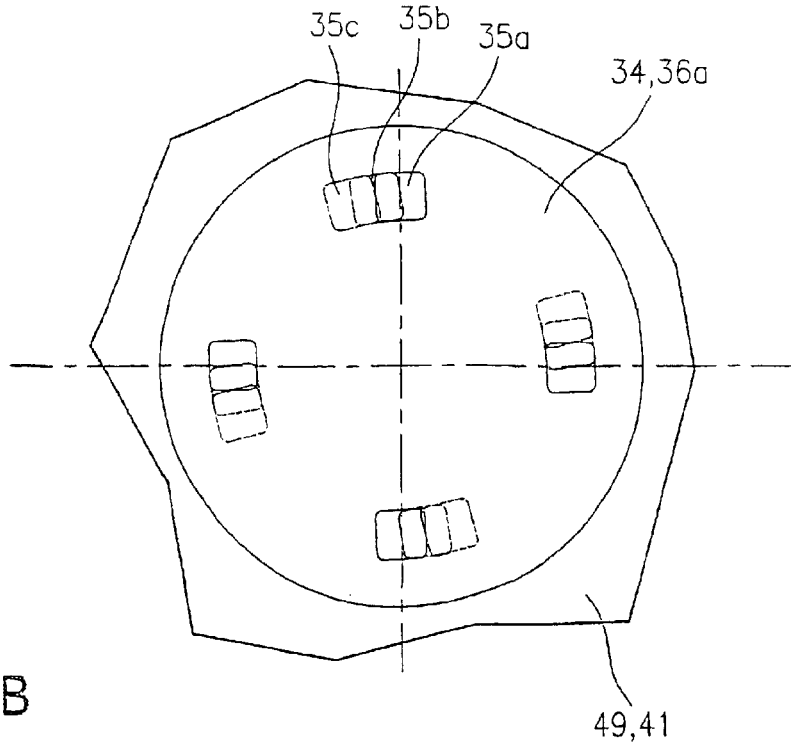
FIG. 3B is a top view of the swirl disk illustrated in FIG. 3A, in the direction of outflow.

FIG. 3B shows a top view of the swirl disk of the second exemplary fuel injector 1 according to the present invention illustrated in FIG. 3A, in the direction of outflow.

Analogous to FIG. 2B, FIG. 3B shows inflow-side first swirl element 36*a*, with square fuel passages 35*a* having rounded corners represented by a solid line. Fuel passages 35*b* of second swirl element 36*b* next closest to the injection side are partially visible through fuel passages 35*a* of first swirl element 36*a*. In the visible areas, fuel passages 35*b* are represented by solid lines, and concealed areas are represented by dotted lines. Fuel passages 35*c*, formed in subsequent third swirl element 36*c*, are visible through fuel passages 35*a* of swirl element 36*a*, but only in a very small area, since fuel passages 35*a* through 35*c* overlap one another by approximately 50%. Since valve-closure member 4 does not pass through swirl elements 36 in the present exemplary embodiment, the swirl elements are disk-shaped design without a central cavity 48.

The number of fuel passages 35 per swirl element 36 is limited by the size of their cross sections. That is, the larger the number of fuel passages 35 per swirl element 36, the smaller the diameter of fuel passages 35 should be to assure a constant fuel flow rate. For reasons of stability, individual fuel passages 35 of each swirl element 36 should be separated from one another by a distance equal to the diameter of fuel passages 35.

The present invention is not limited to the exemplary embodiments described above, but is also applicable, for example, to fuel injectors 1 having a greater number of swirl elements 36 or having larger or smaller fuel passages 35 in any shape or number, as well as to any design of fuel injector 1.

What is claimed is:

1. A fuel injector, comprising:

a valve-closure member;

a valve-seat member including a valve-seat surface, the valve-closure member and the valve-seat surface forming a sealing seat;

a swirl disk including a plurality of swirl elements, each of the swirl elements having at least one fuel passage; wherein each of the swirl elements has a same number of fuel passages, and the plurality of swirl elements are offset with respect to one another so that each of the at least one fuel passages of each of the swirl elements at least partially overlap the fuel passages of another one of the swirl elements, the swirl disk arranged on an outflow side of the sealing seat; and a plug-in unit including a cavity, the plug-in unit being insertable into an outflow-side cavity of the valve-seat member; wherein the swirl disk is arranged in the cavity of the plug-in unit;

wherein a longitudinal axis of the plug-in unit is inclined with respect to a longitudinal axis of the fuel injector.

2. The fuel injector according to claim 1, wherein the fuel injector is configured for direct injection of fuel into a combustion chamber of an internal combustion engine.

3. The fuel injector according to claim 1, wherein the overlapping fuel passages of the swirl elements form fuel channels extending from an inflow side of the swirl disk to an outflow side of the swirl disk.

4. The fuel injector according to claim 3, wherein the valve-seat member further includes a swirl chamber arranged on an outflow side of the swirl disk, and the fuel channels open into the swirl chamber.

5. The fuel injector according to claim 1, wherein the at least one fuel passage has one of a square cross section, a rectangular cross section, and a round cross section.

6. The fuel injector according to claim 5, wherein the at least one fuel passage of each swirl element is rotated in the same direction with respect to one another.

7. The fuel injector according to claim 1, wherein the plurality of swirl elements are welded to one another and to the valve-seat member.

8. The fuel injector according to claim 1, wherein the plug-in unit further includes a spray-discharge orifice and a swirl chamber arranged between the swirl disk and the spray-discharge orifice, and the fuel channels open into the swirl chamber.

* * * * *